US007021232B2

(12) United States Patent
Chen

(10) Patent No.: US 7,021,232 B2
(45) Date of Patent: Apr. 4, 2006

(54) SELF PROPELLED HYDROFOIL DEVICE

(76) Inventor: Shane Chen, 1821 NW. Eight Ave., Camas, WA (US) 98607

( * ) Notice: Subject to any disclaimer, the term of this patent is extended or adjusted under 35 U.S.C. 154(b) by 0 days.

(21) Appl. No.: 10/657,664

(22) Filed: Sep. 7, 2003

(65) Prior Publication Data

US 2005/0051074 A1 Mar. 10, 2005

(51) Int. Cl.
*B63B 1/24* (2006.01)

(52) U.S. Cl. ..... 114/274; 440/21

(58) Field of Classification Search ..... 114/274–282; 440/21–31

See application file for complete search history.

(56) References Cited

U.S. PATENT DOCUMENTS 5,697,317 A * 12/1997 Pereira ..... 114/55.52
6,099,369 A 8/2000 Puzey

OTHER PUBLICATIONS

TRAMPOFOIL marketing flyer. One page. Date unknown. From Sweden.

* cited by examiner

*Primary Examiner*—Ed Swinehart
(74) *Attorney, Agent, or Firm*—Steven J. Adamson

(57) ABSTRACT

A self-propelled hydrofoil device having front and rear foils, a support structure and a steering mechanism. The device is preferably fabricated with a flexible steering and/or support member that permits the drive foil to move in an appropriate manner through water to propel the device forward. Various embodiments are disclosed.

16 Claims, 4 Drawing Sheets

SELF PROPELLED HYDROFOIL DEVICE

FIELD OF THE INVENTION

The present invention relates to hydrofoil devices and, more specifically, to hydrofoil devices that may be configured for self propelled operation.

BACKGROUND OF THE INVENTION

Relevant prior art hydrofoil devices include the "Trampofoil" device disclosed in Swedish Design Patent no. 98-0088 and a Water Vehicle disclosed in U.S. Pat. No. 6,099,369 issued to Puzey.

The Trampofoil discloses a basic self-propelled hydrofoil device having a main foil in the rear and a steerable foil in the front. The '369 patent issued to Puzey discloses a related device that has a biased pivot point located substantially above the rear foil, i.e., under the area at which a user stands when in use (FIG. 9, item 82, or FIG. 10, item 72).

Disadvantageous aspects of the Trampofoil device and the '369 patent include that they may not permit the front edge of the rear or "drive" foil to tilt sufficiently downward in response to a driving leg thrust to adequately propel the craft forward. A significant amount of the downward leg force may thus be impaled upon the foil, rather than shearing through water—wasting significant driving energy. In addition, the steering shaft of the Trampofoil is made of fiberglass which bends not only in the direction of travel, but also laterally, making steering difficult.

Due to these and other disadvantageous aspects, the arrangement of the Trampofoil and that of the '369 patent are difficult to use, particularly by lay persons.

A need thus exists for a hydrofoil device that may be configured for self-propelled operation and is relatively easy to use. A need also exists for a hydrofoil device that provides sufficient forward thrust for the energy expended by the downward thrust of an operators leg's (or other means).

SUMMARY OF THE INVENTION

Accordingly, the present invention is directed towards providing a hydrofoil device that provides ready forward movement in response to driving thrusts or a related force.

The present invention is also directed towards providing a self-propelled hydrofoil device that provides ready forward movement in response to the drive force of the legs of an operator.

Furthermore, the present invention is directed to a self-propelled hydrofoil device that provides a flexible, movable or pivotable support structure substantially forward of a user that causes the front portion of a drive wing to tilt to an appropriate orientation to readily achieve forward movement of the device in response to a drive thrust.

These and related objects of the present invention are achieved by use of a self-propelled hydrofoil device as described herein.

The attainment of the foregoing and related advantages and features of the invention should be more readily apparent to those skilled in the art, after review of the following more detailed description of the invention taken together with the drawings.

DETAILED DESCRIPTION

Figure 1:
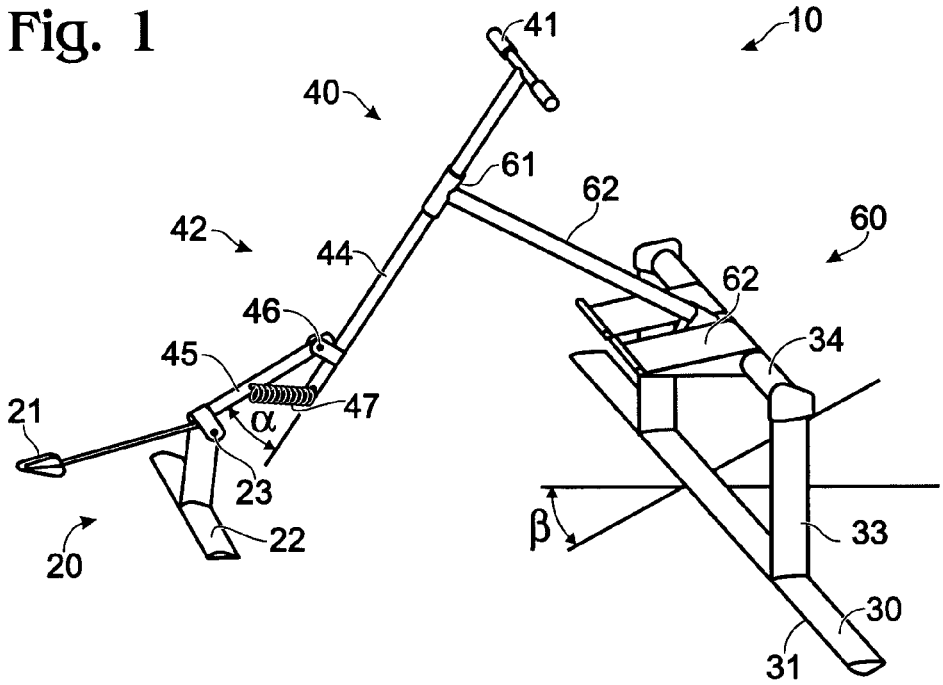
FIG. 1 is a perspective view of a hydrofoil device 10 in accordance with the present invention.

Referring to FIG. 1, a perspective view of a hydrofoil device 10 in accordance with the present invention is shown. Hydrofoil device 10 may include a forward located canard arrangement 20 and a rear or aft located drive foil 30.

The canard 20 may include a plate or spoon 21 (which tracks the water surface) and a foil member 22, or be otherwise arranged. The primary function of the canard is finding and locking onto the water surface and canards and like devices are known in the art.

The principal or drive foil 30 may be one of any suitable hydrofoil "wings" or "foils." Such foils are known in the art. Drive foil 30 may be fixedly coupled to vertical members 33 which may be fixedly coupled to support bar 34. Drive platform 60 is preferably configured to receive a standing human and may include two foot placement plates 62 or be otherwise arranged. Plates 62 are preferably fixedly coupled to bar 34 so that a downward thrust on the plates translates to a similar downward force asserted on foil 30. Note that the plates may be located on the inside edge of support bar 34 such that the substantially downward thrust is first applied to the leading edge 31 of foil 30.

The steering mechanism 40 may include a steering handle 41 coupled to a steering shaft 42 that is provided in sleeve 61. The distal end of the shaft is pivotally coupled to canard 20 at pivot 23. The steering mechanism is preferably coupled to the drive platform via a steering support shaft 62 and associated sleeve 61. The support shaft and sleeve may be securely coupled to the drive platform, for example, to support bar 34.

Shaft 42 preferably includes an upper section 44 and a lower section 45 that are coupled in such a manner that they may pivot or otherwise move relative to one another in such a manner as to achieve a downward tilt in the front edge 31 of drive foil 30.

FIG. 1 illustrates upper and lower steering shaft sections 44,45 jointed at pivot 46 and bias into a given position by bias spring 47. The relative movement of the two sections about pivot 46, indicated as angle $\alpha$, achieves a similar movement in the angle of attack, $\beta$, of leading edge 31 of foil 30. Increases in $\alpha$ and thus $\beta$ correspond to a more aggressive cutting of foil 30 into the water, thereby propelling hydrofoil device 10 forward.

As the thrust of a user is spent, the force of bias spring 47 causes upper and lower sections 44,45 to move towards their "rest position," i.e., into closer alignment, thereby decreasing both $\alpha$ and $\beta$ and ultimately causing leading edge 31 of foil 30 to move upward placing foil 30 back in position for another downward, forward propelling thrust.

Figure 2:
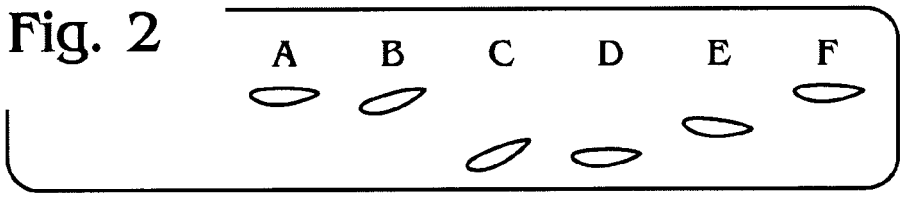
FIG. 2 is a diagram of relative drive foil position during use.

Referring to FIG. 2, a diagram of relative drive foil position during use is shown. Position A is a glide or "steady-state" position as the foil glides through the water. Prior to a leg thrust a user preferably pushes oh steering handle 41. This causes upper and lower sections 44,45 to move apart, i.e., out of alignment, increasing $\alpha$ (and $\beta$) and causing leading edge 31 to tip downward (Position B). The user then asserts a leg thrust on platform 60 causing tip 31 to descend further and causing the entire foil to descend into the fluid medium at an angle, pushing the craft forward against the resistance of the water. The position of foil 30 at this stage is shown is in Position C. As the thrust expires, the force of the bias spring begins to reduce α and β, causing the leading edge to begin to rise and the foil to pass through a substantially steady state position, but further submerged than in Position A (Position D). The leading edge then rises slightly (due in part to the surface finding properties of the canard) causing the foil to rise (Position E) and return to its steady-state position (Position F, and Position A), ready for the next thrust.

Note that while the upper and lower sections 44,45 are preferably moveable in a first dimension to facilitate a desired movement of leading edge 31, they are sufficiently rigid from side to side or in a "steering dimension" to provide adequate steering.

Referring to FIGS. 3–7, other embodiments of a hydrofoil device in accordance with the present invention are shown. The devices illustrated in these figures are intended to illustrate aspects of the breadth of the present invention and in no way to limit the present invention to the illustrated embodiments.

Figure 3:
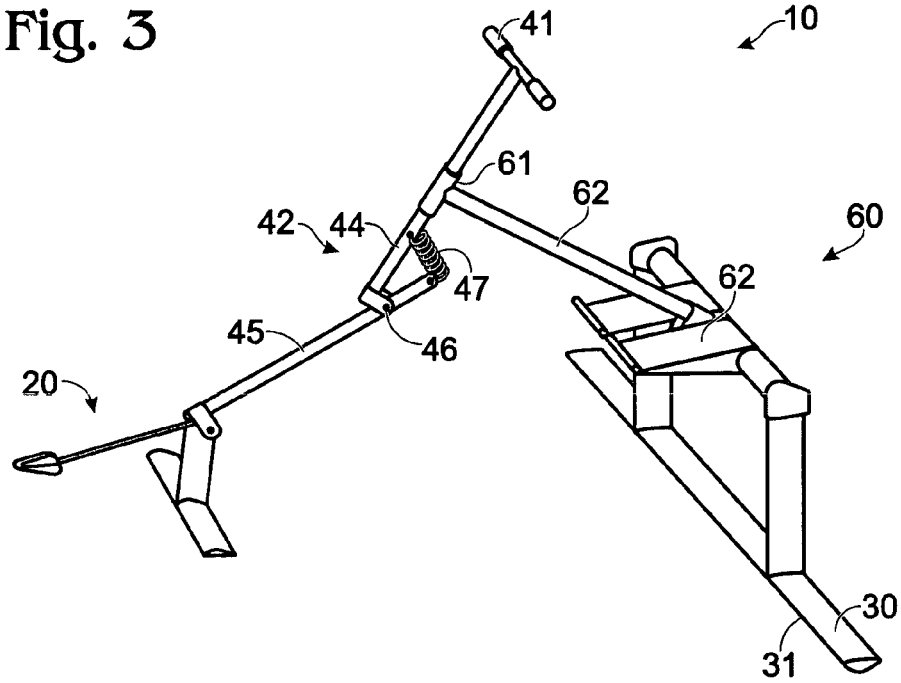
FIGS. 3–7 are perspective views of other embodiments of a hydrofoil device in accordance with the present invention.

FIG. 3 illustrates device 10, but with a pivot arrangement in steering shaft 42 that is different from that shown in FIG. 1. In the embodiment of FIG. 1, the upper section 44 extends past pivot 46. In the embodiment of FIG. 3, the lower section 45 extends past pivot 46. Bias spring 47 in both the embodiments of FIGS. 1 and 3 may be an expansion spring or other suitable means.

Figure 4B:
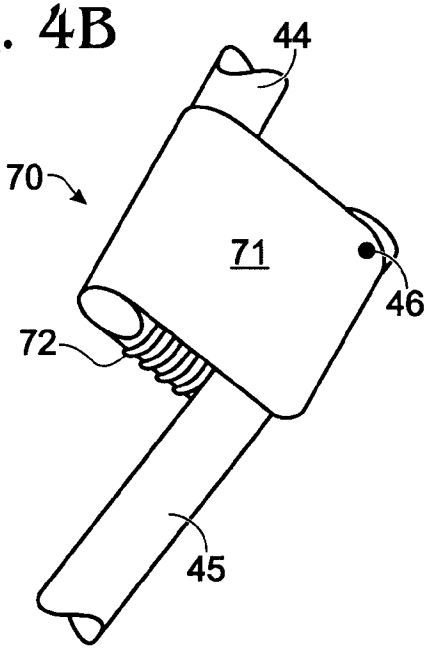
Figure 4A:
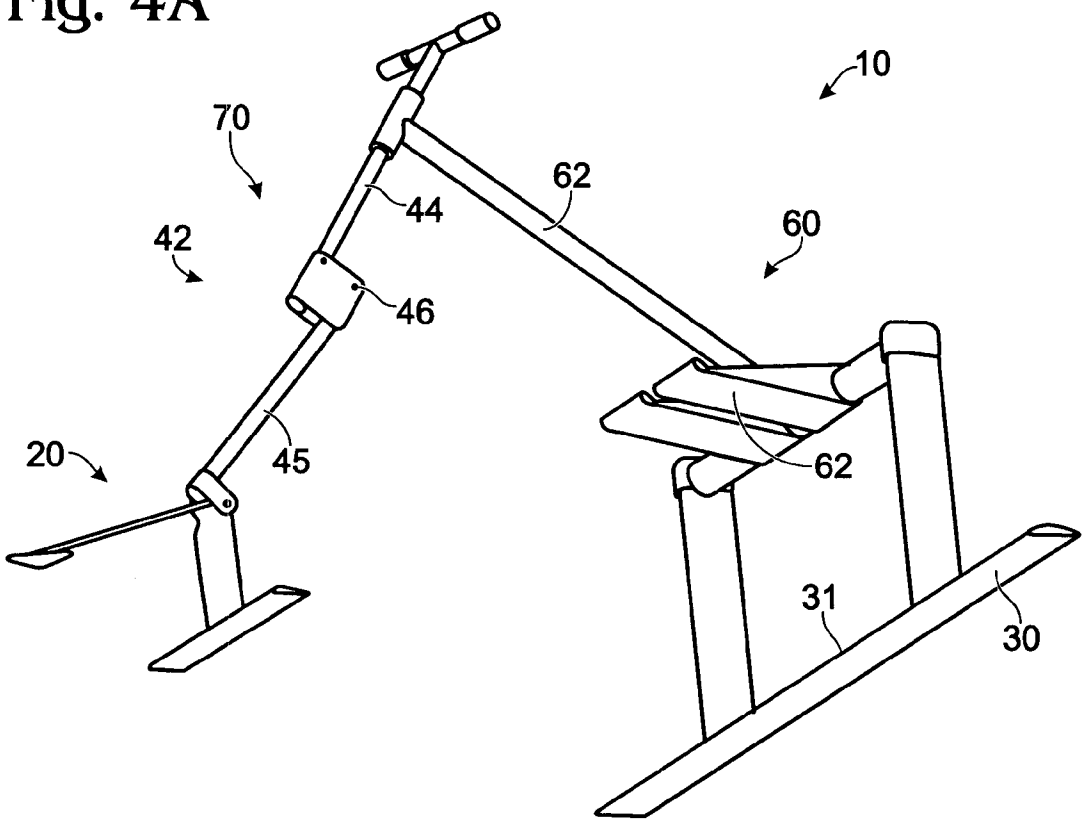

FIG. 4A illustrates a perspective view (from below horizontal) of hydrofoil device 10 having a compression spring based pivot mechanism 70 in steering shaft 42. FIG. 4B illustrates a close-up perspective view of the compression spring based pivot mechanism 70. The embodiment of FIGS. 4A–4B provide a coupling member 71 that couples upper section 44 to lower section 45 via pivot 46. A compression spring 72 is provided between the upper and lower sections 44,45 and adjacent pivot 46 such that it compresses in a manner that increases α and β and expands in a manner that decreases these two angles, such that foil 30 functions as discussed above.

Figure 5:
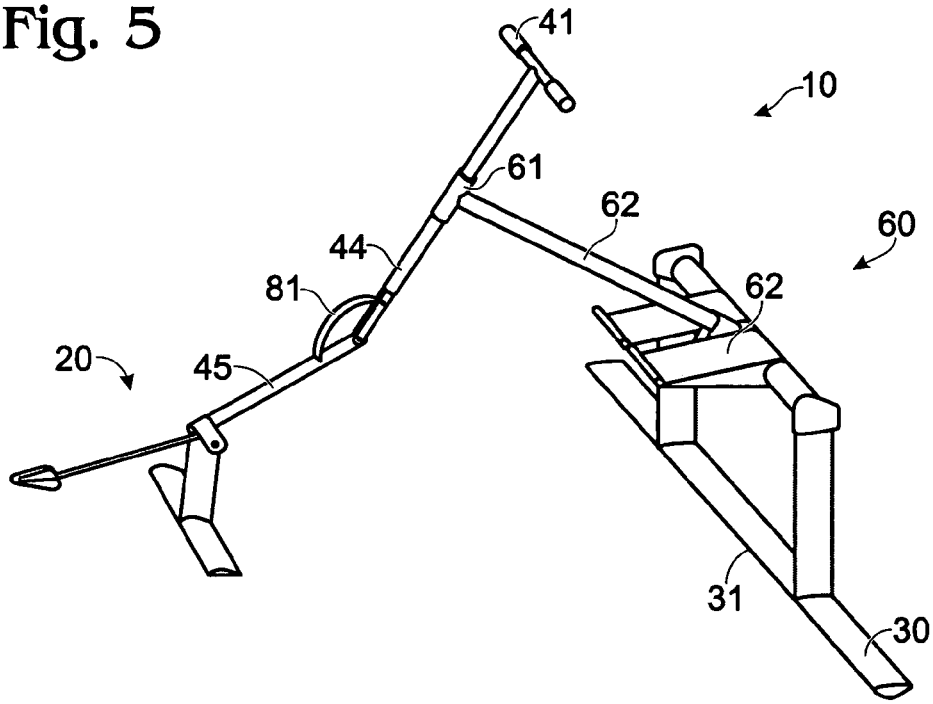

FIG. 5 illustrates hydrofoil device 10, albeit with a leaf spring type mechanism 81 coupled to pivotally connected sections 44,45. The leaf spring 81 may be made of steel or fiberglass or other suitable material. It may be formed with loops at both ends which are then coupled to the respective shaft sections 44,45 by mounting pins.

Other mounting mechanisms may be used. Spring 81 functions in a manner similar to compression spring 72.

Figure 6:
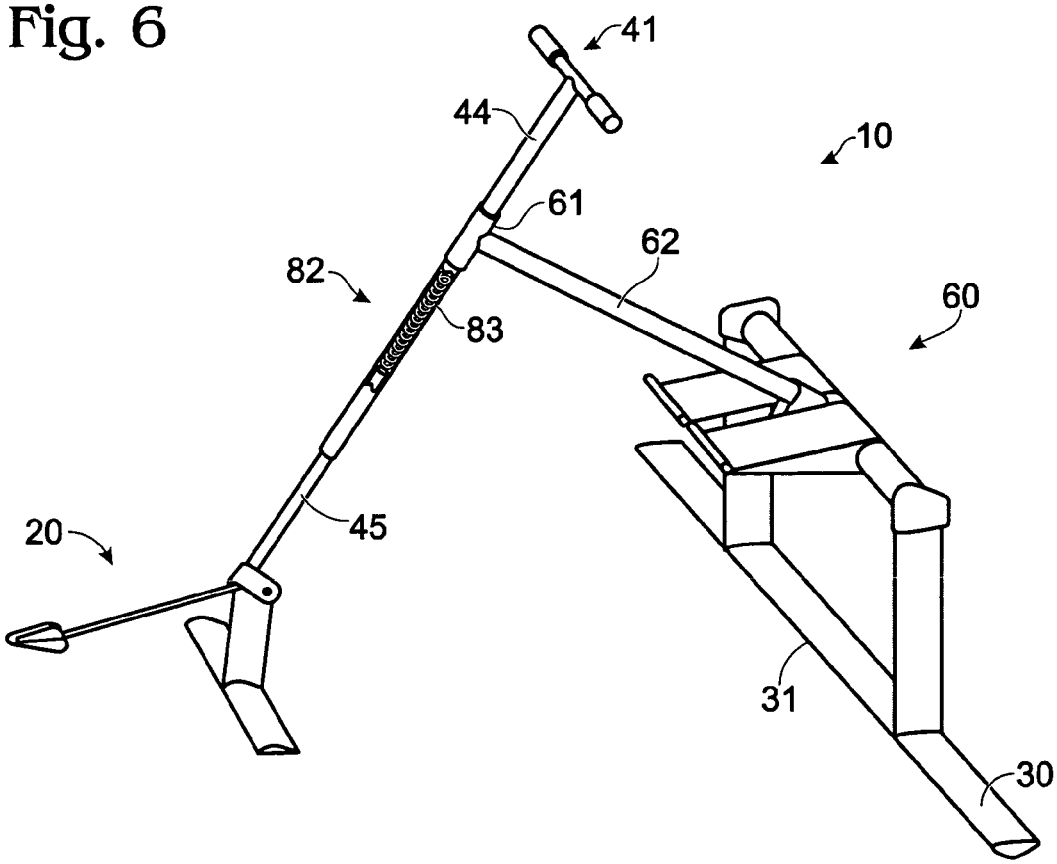

FIG. 6 illustrate hydrofoil device 10, albeit with a linear coil spring 82 coupled between shaft sections 44,45. A support shaft 83 is provided internal to the coil spring and the lower end of support shaft 83 descends into lower section 45. In use, coil spring 82 is compressed when a user pushes down on handle 41 and thrusts his or her leg downward on platform 60. The leg thrust on platform 60 drives the front end 31 of foil 30 downward propelling the craft forward and subsequent expansion of spring 82 pulls foil front end 31 back up through positions D and E to Position F (see FIG. 2).

Figure 7:
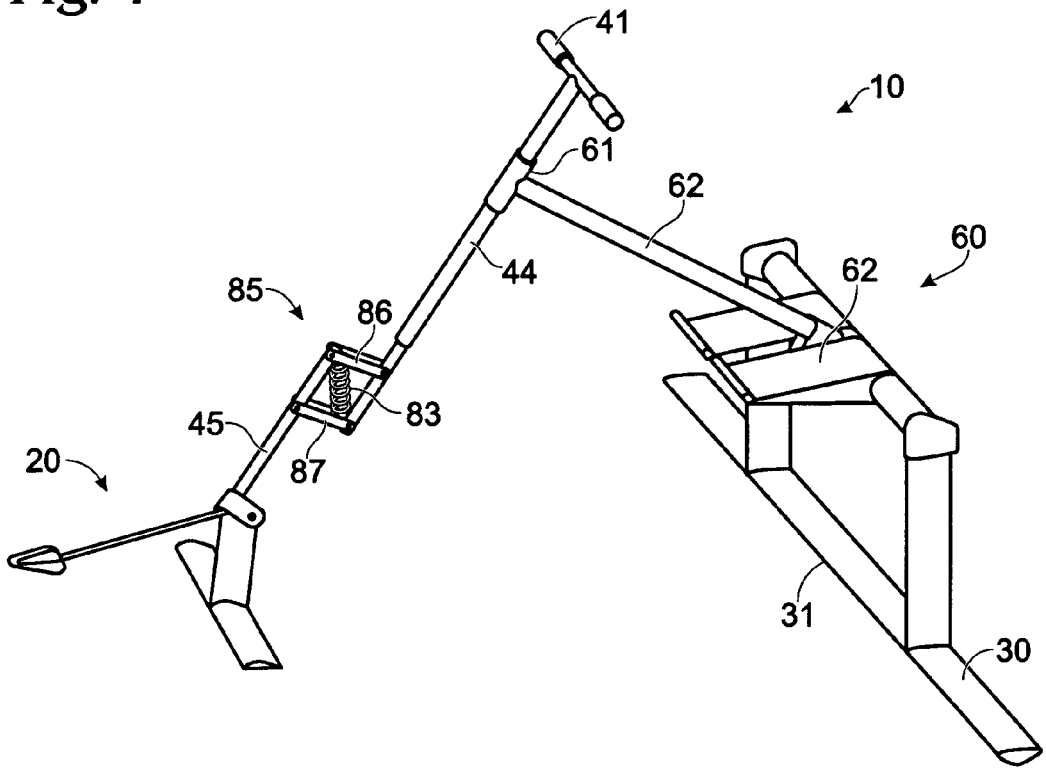

FIG. 7 illustrates hydrofoil device 10, albeit with a parallelogram or like coupling mechanism 85. Mechanism 85 may include two cross-coupling members 86,87 and a spring or other bias member 88. The device of FIG. 7 operates in a manner similar to that described in FIG. 6 (with the two steering shaft sections 44,45 toward or away from one another) and as elsewhere described herein.

The embodiments discussed above may be, but are not necessarily, formed of the following materials. The foils may be formed of aluminum or graphite or fiberglass or another suitable material. The frame is preferably formed of aluminum or another suitable material. Frame components may be welded together or otherwise joined as appropriate and known. The bias mechanisms may include metal or composite springs, rubber or other elastic materials, etc. The handles may include rubber. Plastic may be provided on corners, edges and tube ends, etc., to smooth rough edges, provide seals or join components, etc. Various fabrication materials and techniques are known in the art.

Note also that an alternative steering shaft arrangement can be provided. For example, the steering shaft may be a continues member (instead of two separate sections 44,45) that bends or moves in a similar manner, but is substantially rigid laterally so as to afford adequate steering.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A hydrofoil device, comprising:

a first foil;

a second foil;

a support structure coupling said first foil and said second foil and including a steering structure, wherein said steering structure includes separate first and second steering shaft sections that are moveably coupled to one another, said first and second steering shaft sections having a first relative position at rest and moving to a second relative position in response to a driving force; and a bias mechanism for biasing said first and second steering shaft sections into said first relative position;

wherein said first and second shaft sections are coupled such that they are non-coaxially moveable with respect to one another in a first plane substantially in line with a direction of travel of the device and more rigid in a plane substantially perpendicular to said first plane.

2. The device of claim 1, wherein said steering structure includes a handle and a point of moveable coupling of said first and second shaft sections occurs forward of said handle.

3. The device of claim 1, wherein in response to a downward force exerted on said support structure, said steering structure moves to said second relative position causing the second foil to achieve an angle in the water that drives said device forward.

4. The device of claim 1, wherein the first foil is forwardly located and the second foil is rearwardly located.

5. The device of claim 3, wherein said second foil glides and recovers pre-downward force exertion position as said bias mechanism brings said steering structure back into said first relative position.

6. A hydrofoil device, comprising:

a first foil;

a second foil for driving said device forward; and a support structure coupling said first foil and said second foil and including a steering structure;

wherein said steering structure includes a shaft having first and second shaft sections that are moveable with respect to one another in a first plane substantially in line with a direction of travel of the device and more rigid in a plane substantially perpendicular to said first plane, said first and second shaft sections moving in said first plane between a first relative position and a second relative position, wherein in response to a downward driving force onto said support structure said first and second shaft sections move to said second relative position and in said second relative position said first foil is located forward of its location in said first relative position and said second foil is presented for driving said device forward.

7. The device of claim 6, wherein said first and second shaft sections are separate components that are moveably coupled to one another.

8. The device of claim 7, further comprising a bias mechanism for biasing said first and second shaft sections into said first relative position.

9. The device of claim 6, wherein said steering structure includes a handle and a point of relative movement of said first and second shaft sections occurs forward of said handle.

10. A hydrofoil device, comprising:

a first foil;

a second foil;

a support structure coupling said first and second foils and including a steering structure having a handle, wherein said first foil is coupled to said support structure at a first pivot and said support structure includes a second pivot located between said first pivot and said handle; and a bias mechanism provided with said second pivot to bias a first shaft section and a second shaft section joined at said second pivot towards a given relative position;

wherein, in use, movement of said first shaft section and said second shaft section about said second pivot is in a plane that is substantially more vertical than horizontal.

11. The device of claim 10, wherein said steering structure includes the first and second shaft sections which are moveably coupled to one another at least in part through said second pivot, said first and second shaft sections moving between a first relative position and a second relative position, said second foil being presented for driving said device forward when said shaft sections are in said second relative position.

12. The device of claim 11, wherein said first and second shaft sections are coupled such that they are moveable with respect to one another in a first plane substantially in line with a direction of travel of the device and more rigid in a plane substantially perpendicular to said first plane.

13. The device of claim 11, wherein said first and second shaft sections are moveable between a first position that facilitates diving of the second foil in a manner which propels the device forward, and a second position that facilitates glide of the device near a water surface.

14. The device of claim 10, wherein the first foil is forwardly located and the second foil is rearwardly located.

15. A hydrofoil device, comprising:

a first foil;

a second foil; and a support structure coupling said first foil and said second foil and including a steering structure;

wherein said steering structure includes separate first and second shaft sections that are moveably coupled to one another; and wherein said first and second shaft sections are moveable between a first relative position that facilitates diving of the second foil in a manner which propels the device forward, and a second relative position that facilitates glide of the device near a water surface;

said steering structure being configured such that said first and second shaft sections are biased towards said second position;

wherein said first and second shaft sections are moveable with respect to one another in a first plane substantially in line with a direction of travel of the device and more rigid in a plane substantially perpendicular to said first plane; and wherein said first foil is spaced at a greater distance from said second foil in said first relative position than in said second relative position.

16. The device of claim 15, wherein said bias acts to move said first and second shaft sections from said first position to said second position after exertion of a force that places said shaft sections into said first relative position; and wherein said first and second shaft sections move non-coaxially with respect to one another.

* * * * *